US008940129B2

(12) United States Patent
Chen et al.

(10) Patent No.: US 8,940,129 B2
(45) Date of Patent: Jan. 27, 2015

(54) PROCESS FOR REDUCING ONE OR MORE INSOLUBLE SOLIDS IN A BLACK LIQUOR

(75) Inventors: John Q. Chen, Glenview, IL (US); Mark B. Koch, Mt. Prospect, IL (US)

(73) Assignee: UOP LLC, Des Plaines, IL (US)

( * ) Notice: Subject to any disclaimer, the term of this patent is extended or adjusted under 35 U.S.C. 154(b) by 105 days.

(21) Appl. No.: 13/237,070

(22) Filed: Sep. 20, 2011

(65) Prior Publication Data

US 2012/0168101 A1 Jul. 5, 2012

Related U.S. Application Data

(60) Provisional application No. 61/428,832, filed on Dec. 30, 2010.

(51) Int. Cl.
*D21C 11/00* (2006.01)

(52) U.S. Cl.
CPC ..... *D21C 11/00* (2013.01)
USPC ..... 162/16

(58) Field of Classification Search
USPC ..... 162/16
See application file for complete search history.

(56) References Cited

U.S. PATENT DOCUMENTS

| | | | | |
|---|---|---|---|---|
| 5,180,868 | A * | 1/1993 | Baker et al. | 585/240 |
| 5,635,027 | A | 6/1997 | Spontak et al. | |
| 5,777,086 | A | 7/1998 | Klyosov et al. | |
| 5,900,112 | A | 5/1999 | Spontak et al. | |
| 5,959,167 | A | 9/1999 | Shabtai et al. | |
| 6,261,411 | B1 * | 7/2001 | Roberts | 162/14 |
| 7,109,384 | B2 | 9/2006 | Perdices et al. | |
| 2004/0176647 | A1 | 9/2004 | Perdices et al. | |
| 2007/0161095 | A1 | 7/2007 | Gurin | |
| 2007/0178569 | A1 | 8/2007 | Leschine et al. | |
| 2008/0138862 | A1 | 6/2008 | Felby et al. | |
| 2009/0017513 | A1 | 1/2009 | Bell et al. | |
| 2010/0069589 | A1 * | 3/2010 | Bradin | 526/170 |

FOREIGN PATENT DOCUMENTS

| | | | |
|---|---|---|---|
| EP | 0532491 | A1 | 3/1993 |
| JP | 2008-011753 | A | 1/2008 |
| WO | 8301469 | A1 | 4/1983 |

OTHER PUBLICATIONS

Lars-Hugo Ullmann's Encyclopedia of Industrial Chemistry, Published Jun. 15, 2000 section "Tall Oil" pp. 583-596.*

Argyropoulos et al., "Chemical Extraction of Wood Hemicelluloses: An Invaluable New Proposition for the Pulp and Paper Industry", 2005 AIChE Spring Conference Proceedings, 2005, p. 363.

(Continued)

*Primary Examiner* — Jacob Thomas Minskey

(57) ABSTRACT

One exemplary embodiment can be a process for reducing one or more insoluble solids in a black liquor. The process may include hydrothermal processing the black liquor to a temperature of about 250-less than about 300° C. for an effective time to reduce the one or more insoluble solids by more than about 40%, by weight, based on a weight of the one or more insoluble solids prior to hydrothermal processing.

15 Claims, 2 Drawing Sheets

(56) References Cited

OTHER PUBLICATIONS

Demirbas, "Recovery of Oily Products from Organic Fraction of Black Liquor via Pyrolysis", Energy Sources, Part A: Recovery, Utilization and Environmental Effects, Jan. 2008, vol. 30, No. 20, pp. 1849-1855.

El-Saied, "Liquefaction of Lignohemicellulosic Waste by Processing with Carbon Monoxide and Water", Journal Applied Chemical Biotechnology, Sep. 1977, vol. 27, No. 9, pp. 443-452.

Louhelainen et al., "Effects of Oxidative and Non-Oxidative Thermal Treatments on Viscosity and Chem. Composition Softwood Kraft Black Liquor", Journal of Pulp and Paper Science, Sep. 2002, vol. 28, No. 9, pp. 285-291.

Sugano et al., "Hydrothermal Liquefaction of Plantation Biomass with Two Kinds of Wastewater from Paper Industry", Journal of Materials Science, Apr. 2008, vol. 43, No. 7, pp. 2476-2486.

* cited by examiner

PROCESS FOR REDUCING ONE OR MORE INSOLUBLE SOLIDS IN A BLACK LIQUOR

CROSS-REFERENCE TO RELATED APPLICATION

This application claims the benefit of U.S. Provisional Application No. 61/428,832 filed Dec. 30, 2010, which is hereby incorporated by reference in its entirety.

FIELD OF THE INVENTION

This invention generally relates to a process for reducing one or more insoluble solids in a black liquor.

DESCRIPTION OF THE RELATED ART

Generally, lignin is a byproduct from paper and pulp processes. Often, lignin is recovered by acidifying a black liquor to recover a precipitate. Typically only about 70%, by weight, of the lignin is recovered. However, it is desirable to recover as much of the remaining about 30%, by weight, lignin for use as a feedstock.

Black liquor can be a suspension of liquid and one or more insoluble solids. Black liquor can be a significant waste stream in the paper and pulp industry. As a result, there is a desire to process this stream economically to find a better usage of its composition, specifically the lignin.

Usually, the lignin in the black liquor can be incorporated into the insoluble solids. The precipitated lignin can optionally be purified before utilization as a boiler fuel or fillers. Unfortunately, these applications have a relatively low value compared to other potential uses.

Particularly, lignin can include a large amount of polymerized aromatic ring radicals forming a structure. Desirably, conversion of the one or more insoluble solids into liquid may also break down the lignin structure into individual aromatic compounds, which can serve as a feedstock for the production of higher value products, such as aromatic and phenol based chemicals or fuels.

Generally, lignin can also be depolymerized by using a base catalyst in a hydrolysis process. However, this process generally requires a high caustic consumption that can have a negative impact on its economics as well as the environment. Thus, there is a desire to process black liquor effectively and efficiently for recovering components of the lignin for use in valuable feedstocks.

SUMMARY OF THE INVENTION

One exemplary embodiment can be a process for reducing one or more insoluble solids in a black liquor. The process may include hydrothermal processing the black liquor to a temperature of about 250-less than about 300° C. for an effective time to reduce the one or more insoluble solids by more than about 40%, by weight, based on a weight of the one or more insoluble solids prior to hydrothermal processing.

Another exemplary embodiment may be a process for reducing one or more insoluble solids in a black liquor. The process can include hydrothermal processing the black liquor to a temperature of about 250-about 290° C. to reduce the one or more insoluble solids by more than about 40%, by weight, based on a weight of the one or more insoluble solids prior to hydrothermal processing. Generally, the black liquor includes one or more insoluble solids, lignin, water, and at least one alkali hydroxide.

A further exemplary embodiment can be a process for reducing one or more insoluble solids in a black liquor. The process can include hydrothermal processing a composition consisting of the black liquor and optionally added water to a temperature of about 250-about 290° C. The black liquor may include about 5-about 85%, by weight, the one or more insoluble solids, about 15-about 95%, by weight, water, about 0.1-about 5%, by weight, tall oil, and about 1-about 25%, by weight, of at least one alkali metal.

The embodiments disclosed herein can eliminate the requirement of lignin acid precipitation and purification by directly hydrothermal processing the lignin in its black liquor. Particularly, a sample of black liquor can be heated and using the existing water and/or caustic compounds existing in the black liquor, lignin can be depolymerized to lower molecular weight lignin compounds, such as phenolic oligomers and monomers. These compounds can dissolve, thus reducing the solids composition in the black liquor. Afterwards, the liquid including these degraded compounds can be separated and processed for use in downstream aromatic and other chemical processes.

As a result, several benefits can be obtained. Lignin potentially lost during a precipitation process can be degraded and converted into higher value products. Particularly, up to substantially about 100% or about 100%, by weight, of the lignin can be obtained from the black liquor by hydrothermal processing, liquefying, and filtering. Moreover, acid usage may be reduced lowering the lignin purification cost, while requiring no additional catalyst due to the presence of alkali metal hydroxides, such as sodium and potassium. Additionally, the process can be conducted continuously or in batch steps.

Definitions

As used herein, the term "black liquor" can mean a liquor resulting from the cooking of pulpwood in an alkaline solution in a soda or sulfate, such as a Kraft, paper making process. Generally, the black liquor can be a source of lignin and tall oil.

As used herein, the term "lignin" can mean a phenylpropane polymer of amorphous structure including about 17-about 30%, by weight, wood. Lignin can be associated with holocellulose that can make up the balance of a wooden material separated by conducting a chemical reaction at a high temperature. Generally, although not wanting to be bound by theory, it is believed that lignin serves as a plastic binder for holocellulose fibers.

As used herein, the term "cellulose" can mean a natural carbohydrate-high polymer, e.g., polysaccharide, including anhydroglucose units joined by an oxygen linkage to form long molecular chains that are essentially linear. The degree of polymerization can be about 1,000 units for wood pulp to about 3,500 units for cotton fiber with a molecular weight of about 160,000-about 560,000.

As used herein, the term "hemicellulose" can mean cellulose having a degree of polymerization of 150 or less.

As used herein, the term "holocellulose" can mean the water-insoluble carbohydrate fraction of wood.

As used herein, "tall oil" can be a mixture of rosin acids, fatty acids, and other materials obtained by an acid treatment of alkaline liquors from digesting or pulping of woods, such as pine. Moreover, the spent black liquor from the pulping process can be concentrated until the sodium salts, such as soaps, of the various acids can be separated and then skimmed off. These salts can be acidified by sulfuric acid. The composition of properties can vary widely, but can average about 35-about 40%, by weight, rosin acids and about 50-about 60%, by weight, of fatty acids.

As used herein, the term "rich" can mean an amount of at least generally about 50%, and preferably about 70%, by weight, of a compound or class of compounds in a composition.

As used herein, the term "substantially" can mean an amount of at least generally about 80%, preferably about 90%, and optimally about 99%, by weight, of a compound or class of compounds in a composition.

As used herein, "grams" may be abbreviated "g".

As used herein, "milliliter" may be abbreviated "ml".

As used herein, "insoluble solids percent" can be calculated by measuring the amount of solids in a solution or suspension, then dividing by the total weight of the solution or suspension, and multiplied by one-hundred percent.

DETAILED DESCRIPTION

Figure 1:
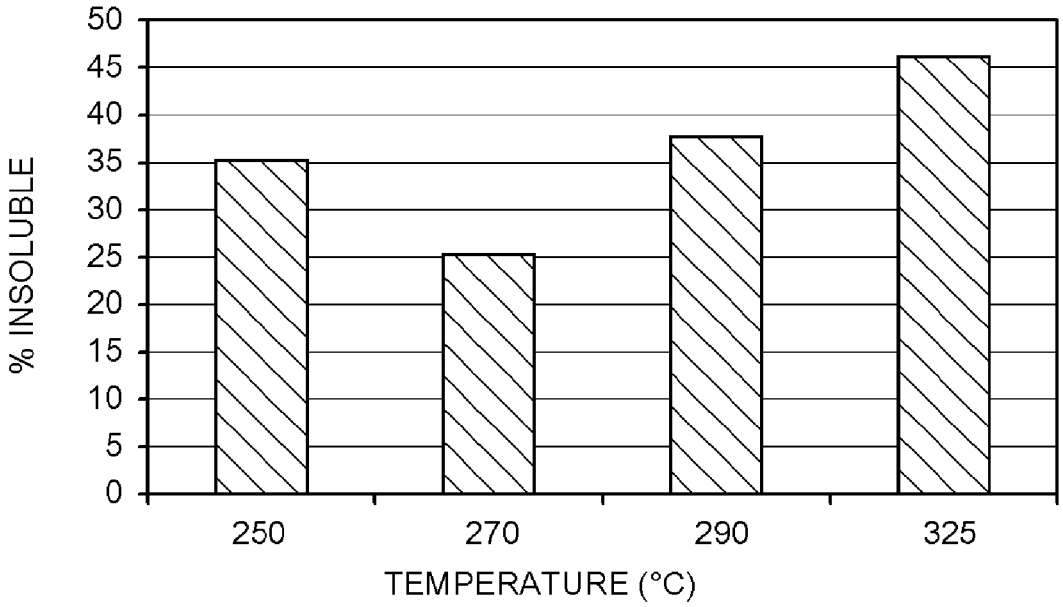
FIG. 1 is a graphical depiction of the percent of insoluble solids versus temperature for various samples of black liquor.

Black liquor can be a byproduct of a paper making process, such as an alkaline Kraft or sulfate process. Black liquor may be a mixture of several basic elements, namely carbon, hydrogen, oxygen, sodium, and sulfur. Generally, black liquor can be highly viscous and contain inorganic cooking chemicals and organic materials such as lignin and aliphatic acids that may be separated from the wood during a chemical cooking process. Black liquor can also include small amounts of wood extractives and residual inorganic salt.

As mentioned, black liquor can be generated as a waste stream during the paper making process. Paper can be made from a wide variety of materials, such as flax, bagasse, esparto, straw, papyrus, bamboo, and jute, but may typically be made from materials such as spruce, hemlock, pine, poplar, and oak.

Black liquor can vary in its composition due to the particulars of the paper making process and the materials used to form the paper. Generally, black liquor can have the following composition as depicted in Table 1 below.

TABLE 1

(All Percentages, By Weight, Based on the Weight of the Black Liquor)

| Material | General | Preferred | Optimal |
|---|---|---|---|
| Organic and Inorganic Solids | about 5-about 85 | about 10-about 70 | about 15-about 50 |
| Water | about 15-about 95 | about 30-about 90 | about 50-about 85 |
| Tall Oil | about 0.1-about 5 | about 0.1-about 3 | about 0.2-about 2 |
| Sodium and Potassium | about 1-about 25 | about 2-about 20 | about 3-about 15 |

The weight ratio of one or more organic solids in the insoluble solids and weight percent of the lignin in the one or more organic solids of the black liquor are depicted in the table below:

TABLE 2

| Material | General | Preferred | Optimal |
|---|---|---|---|
| Organic to Inorganic Solids Weight Ratio | about 0.1:1-about 5:1 | about 1:1-about 3:1 | about 1.5:1-about 2.5:1 |
| Lignin in Organic Solids in Weight Percent | about 10-about 90% | about 30-about 70% | about 40-about 60% |

The process herein can utilize hydrothermal processing to degrade the lignin into lower molecular weight compounds. The heating degrades lignin into lower molecular weight lignin and associated phenolic compounds. This extracted material can separate into a liquid, which can be subsequently separated or isolated from the remaining solids using any suitable method, such as filtration. Typically, the black liquor can contain insoluble solids that can contain undissolved lignin. Generally, it is desirable to reduce these insoluble solids to extract as much lignin from the solid. The lignin, in turn, can degrade from high molecular to lower molecular compounds, such as phenolic oligomers and monomers.

Generally, the embodiments disclosed herein provide hydrothermal processing at a temperature of about 250-less than about 300° C., preferably about 250-about 290° C., and optimally about 260-about 280° C. The time period at the hydrothermal processing temperature is effective for degrading the lignin, such as about 30-about 120 minutes, preferably about 60 minutes. Typically, the black liquor can include about 5-about 85%, by weight, one or more insoluble solids prior to hydroprocessing. The one or more insoluble solids can be reduced by more than about 40%, preferably about 50%, and optimally about 60%, by weight, based on a weight of the one or more insoluble solids prior to hydrothermal processing. The one or more insoluble solids often include organic and inorganic compounds. As such, the one or more insoluble compounds cannot be reduced to a liquid phase completely, rather only a portion can change phases and usually from this portion lignin can be recovered. Often, the black liquor can include water and at least one alkali metal, such as sodium and/or potassium. Optionally water, such as de-ionized water, may be added in an amount of up to about 400%, by weight, of the black liquor. Typically, the sodium and/or potassium are in the form of, respectively, sodium hydroxide and potassium hydroxide that may aid in the dissolving of the one or more insoluble solids.

After the one or more insolubles are reduced, the liquid may be separated by using any suitable process, such as filtration. The filtrate can then be provided to a subsequent process for the production of aromatics or other compounds, such as phenol derivatives or subsequently be used for fuel. Thus, the material may be recovered to be utilized as a higher valued feedstock.

As an example, the liquid or filtrate including degraded compounds can be separated and processed for use in downstream aromatic and other chemical processes. The downstream processing may include deoxygenating, dehydrogenating, and/or cracking in the presence of a catalyst. Typically, the liquid is contacted with the catalyst. The catalyst may include one or metals, such as a noble metal, e.g., platinum, palladium, rhodium, ruthenium, and/or iridium, and/or a transition metal, e.g., nickel, tungsten, and/or molybdenum, for catalyzing deoxygenation and dehydrogenation reactions. The transition metal may be present in the form of a sulfide and/or phosphide thereof. The catalyst may also include a zeolite and/or a silica-alumina support for providing acidity for facilitating cracking. Usually, at least one noble metal and optionally at least one transition metal are deposited on the support. In some exemplary embodiments, the metal can also facilitate cracking. The reaction can occur at a pressure of about 1 kPa-about 1020 kPa, a temperature of about 350-about 700° C., and a liquid hourly space velocity of about 0.1-about 50 $hr^{-1}$. Generally, the product stream includes benzene or at least one alkylbenzene that can be separated for use as precursors to other processes, including the formation of fuel feedstock.

ILLUSTRATIVE EMBODIMENTS

The following examples are intended to further illustrate the subject embodiments. These illustrations of embodiments of the invention are not meant to limit the claims of this invention to the particular details of these examples. These examples are based on engineering calculations and actual operating experience with similar processes.

Four samples of 30 g of black liquor having 70%, by weight, solids are obtained. Each sample is placed into a clean 300 ml autoclave along with 96 g of de-ionized water. The autoclave is sealed and pressure tested with nitrogen to 11,800 kPa-12,600 kPa. After the pressure test, the autoclave is depressurized to 103 kPa and the system is closed. Each mixture is mixed at 500 rotations per minute with the heating started. After a period of about 1-about 1.5 hours, the autoclave reaches the temperature of 250-325° C.

At that point, the clock starts for each sample that is processed for 120 minutes at one of four temperature set points, namely 250, 270, 290, and 325° C. Due to the production of gases and vapor pressure of the water at a temperature, the pressure in the autoclave can increase. The pressure in the autoclave ranges from 4,200-12,600 kPa and may be temperature dependent. After two hours at a temperature of, respectively, 250, 270, 290, or 325° C., the autoclave may be cooled with a stream of nitrogen.

A gas sample can be taken with the autoclave at less than 90° C. The amount of gas produced is usually less than about 150 ml. When the autoclave is cooled to less than 30° C., the mixer is stopped and the autoclave vented. The autoclave is opened and the contents collected along with any water used to rinse out the autoclave. The material is processed as follows.

A reaction mixture is cooled and then harvested from the autoclave with the rinse water. The combined washes and mixture are then acidified with a concentration of hydrogen chloride to a pH of less than 2. The result is a mixed solution including solids in an aqueous phase. The mixture is cooled overnight in a refrigerator. The cooled mixture is then filtered on a tared paper filter, and the filtrate weight is determined and analyzed for carbon content by total organic carbon analysis.

The retentate on the filter is washed with ether into a tarred filter flask until the rinse is clear. The filter is then dried in an oven and the solids determined from the dry weight. The ether washes or the ether fraction which contains the products are brought to dryness by first evaporating the ether with a nitrogen stream. Most of the ether is removed by drying overnight in a 45° C. oven. The flask is then weighed to determine the weight of the products. The content of the filtrate, the solids, and product ether fraction are all measured to calculate the carbon mass balance.

As discussed above, the four samples are hydrothermally processed at four temperatures, namely Sample 1 at 250° C., Sample 2 at 270° C., Sample 3 at 290° C., and Sample 4 at 320° C. At 60 minutes as the set point temperature, FIG. 1 depicts the amount of insoluble solids after heating for Samples 1-4. The four samples can have a percentage of insoluble solids after heating of about 35% (Sample 1), about 25% (Sample 2), about 37% (Sample 3), and about 46% (Sample 4), by weight. This amount of solids reduction can be calculated by as follows:

((initial solids content)−(final solids content))/initial solids content*100

Thus, each Sample 1, 2, 3, and 4 has a percent reduction of, respectively, about 50%, about 64%, about 47%, and about 34%, with respect to the initial amount of solids of 70%, by weight, in the black liquor.

As depicted, a temperature of 270° C. yields the lowest amount of insoluble solids material, as compared to 250° C. and 290° C. Moreover, Samples 1-3 have significantly reduced insoluble solids, as compared to Sample 4.

Figure 2:
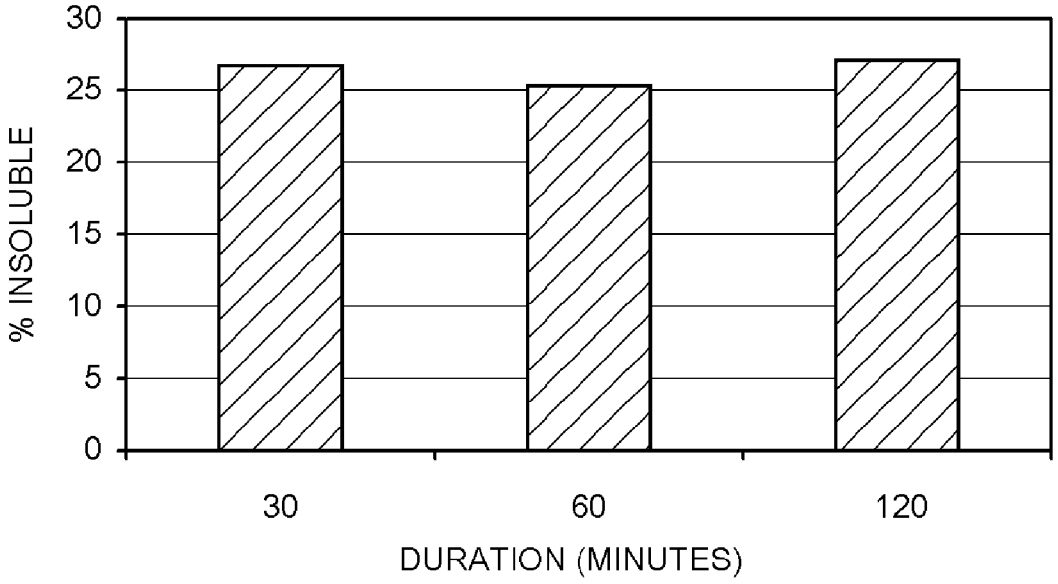
FIG. 2 is a graphical depiction of the percent of insoluble solids versus duration of hydrothermal processing for several black liquor samples.

Referring to FIG. 2, the insoluble solid content of Sample 1 is calculated at 30, 60, and 120 minutes. As depicted, the length of time for the sample has little effect on the amount of insoluble content. Hence, it appears that the temperature, as opposed to the duration, is the primary driver for dissolving insoluble solids.

The embodiments disclosed herein provide a hydrothermal process for reducing the one or more insoluble solids in black liquor. The process allows the conversion of the insoluble solids to liquefied lignin and degraded compounds into a liquid phase. As a consequence, potential valuable feedstocks can easily be separated by processes, such as filtration, and be used in subsequent chemical processing for producing valuable fuels or chemical products.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for converting lignin in a black liquor, comprising:

hydrothermal processing the black liquor to a temperature of about 250- about 290° C., wherein the black liquor comprises about 5 to about 85%, by weight, one or more insoluble solids prior to hydrothermal processing, and wherein the one or more insoluble solids are reduced by more than about 40%, by weight, based on a weight of the one or more insoluble solids prior to hydrothermal processing, separating the hydrothermally processed black liquor into a liquid and an insoluble portion;

recovering the liquid portion; and deoxygenating, dehydrogenating, and/or cracking the recovered liquid portion in the presence of a catalyst.

2. The process according to claim 1, wherein the hydrothermal processing is at a temperature of about 260-about 280° C.

3. The process according to claim 1, wherein the black liquor further comprises water and at least one alkali hydroxide prior to hydrothermal processing.

4. The process according to claim 3, wherein the one or more insoluble solids comprises one or more organic and inorganic compounds.

5. The process according to claim 4, wherein a weight ratio of the one or more organic compounds to one or more inorganic compounds in the one or more insoluble solids is about 0.1:1-about 5:1.

6. The process according to claim 5, wherein the one or more organic compounds comprises about 10-about 90%, by weight, lignin based on the weight of the one or more organic compounds in the one or more insoluble solids.

7. The process according to claim 5, wherein the one or more organic compounds comprises about 40-about 60%, by weight, lignin based on the weight of the one or more organic compounds in the one or more insoluble solids.

8. The process according to claim 4, wherein a weight ratio of the one or more organic compounds to one or more inorganic compounds in the one or more insoluble solids is about 1:1-about 3:1.

9. The process according to claim 3, wherein the at least one alkali metal comprises sodium and potassium.

10. The process according to claim 1, wherein the black liquor comprises hydroxides of at least one of sodium and potassium.

11. The process according to claim 1, wherein the catalyst comprises platinum, palladium, rhodium, ruthenium, iridium, nickel, tungsten, and/or molybdenum, and a zeolite and/or silica-alumina support.

12. The process according to claim 1, wherein the deoxygenating, dehydrogenating, and/or cracking occurs at a pressure of about 1 kPa-about 1020 kPa, a temperature of about 350-about 700° C., and a liquid hourly space velocity of about 0.1-about 50 $hr^{-1}$.

13. The process of claim 1 further comprising using the recovered liquid portion as a feedstock to an aromatic production process.

14. The process of claim 13 wherein the aromatic production process generates an effluent stream comprising benzene.

15. The process of claim 13 wherein the aromatic production process generates an effluent stream comprising at least one alkylbenzene.

* * * * *